US005140718A

United States Patent [19]

Toth

[11] Patent Number: 5,140,718

[45] Date of Patent: Aug. 25, 1992

[54] SPAR TRACK CLEANING AND MAINTENANCE DEVICE

[76] Inventor: John B. Toth, 11685 W. 25th Ave., Lakewood, Colo. 80215

[21] Appl. No.: 623,692

[22] Filed: Dec. 7, 1990

[51] Int. Cl.[5] ..... A47L 25/00

[52] U.S. Cl. ..... 15/210.1; 15/104.94; 114/221 R

[58] Field of Search ..... 15/104.94, 209 R, 210 R, 15/222, 246, 104.93, 210 B; 114/102, 103, 105, 108, 221 R; 134/6, 8, 42; 118/254; 401/9; 51/294, 400

[56] References Cited

U.S. PATENT DOCUMENTS

| | | | |
|---|---|---|---|
| Re. 31,829 | 2/1985 | Stearn | 114/108 X |
| 3,058,138 | 10/1962 | Tomlinson | 15/104.94 X |
| 3,332,103 | 7/1967 | Case | 15/210 R X |
| 3,658,025 | 4/1972 | Hood et al. | 114/105 |
| 3,851,609 | 12/1974 | Stearn | 114/108 X |
| 3,961,392 | 6/1976 | Young . | |
| 4,114,504 | 9/1978 | Koregelos | 15/206 X |
| 4,208,755 | 6/1980 | Shepherd . | |
| 4,278,472 | 7/1981 | Swanson . | |
| 4,899,416 | 2/1990 | Francis | 114/221 R X |

*Primary Examiner*—Timothy F. Simone
*Assistant Examiner*—C. Cooley
*Attorney, Agent, or Firm*—Ken Richardson

[57] ABSTRACT

The spar track cleaning and maintenance device comprises: a compressible, working surface for cleaning, lubricating and maintenance of a longitudinally extending, irregularly-shaped, spherical opening defined by a spar track; at least a first compressible, resiliently flexible, cordage member for inserting into the spar track opening and for slidably engaging an internal surface of the track opening; and a control means for adjustably shaping the working surface and the first cordage member upon being inserted within the spar track opening.

The control means adjustably shapes the working surface and the first cordage member which is integrally formed with the working surface to allow the working surface and the first cordage member to compress and substantially conform to the irregular spherical shape of the internal track surface and be in slidable engagement therewith. The compressed working surface and the first cordage member upon being slidably moved within the track opening reduces friction at the internal track surface and enhances the sliding of the mating slides and boltropes when under loadings from the sail.

28 Claims, 2 Drawing Sheets

SPAR TRACK CLEANING AND MAINTENANCE DEVICE

BACKGROUND OF THE INVENTION

1. Field of the Invention

This invention generally relates to the cleaning and preventive maintenance of sailboats, and more particularly, to a device for maintaining a spar track for the free running of sail slides and boltropes under sail loadings.

2. Background Information

Sails, supporting spars and rigging form a sailboat system for movement and navigation. A spar can generally be defined as a pole or system of poles used to support sails. Spars are used herein to describe other sail supports such as mast, booms, gaffs and headfoils. The handling of sails to allow navigation of the sailboat, particularly the hoisting and lowering of sails, depends on spar tracks or grooves and mating slides, slugs, boltropes and luffropes.

Tracks can generally be described as elongated slot-like or channel-like fittings having a T-shaped or bottle-shaped profile and are normally longitudinally positioned on a spar. Slides or slugs are usually interchangeably referred to and may be simply described as fittings that interconnect the sail and the spar track to hold the sail thereto.

Similarly, boltropes and luffropes typically function to interconnect and hold the sail to the spar. Boltropes are usually stitched to a bottom edge or foot of a sail, while luffropes are typically stitched to a luff edge or forward edge of a sail. Boltropes and luffropes are substantially equivalent to one another, although boltropes normally are used with different types of spars than luffropes. For instance, boltropes are typically used with boom tracks, while luffropes are normally used with mast tracks. Therefore, boltropes will be defined herein to include luffropes.

A number of spar tracks are fabricated from metal, metal alloy, or plastic materials. Spar tracks so constructed are designed to mate with boltropes and slides fabricated from non-metallic natural materials or non-metallic synthetic materials. Some spar track and mating slide arrangements are completely made of metal, metal alloy or plastic materials. The metal of popular choice for fabricating spar tracks is aluminum. This choice is dictated in part because of aluminum's great strength, durability, light weight and low cost with respect to other marine metals; and because aluminum spars will normally be hollow and comprise extruded aluminum tracks.

Slides and boltropes are inserted within the spar tracks through openings therein. The inserted slides and boltropes cannot become free at the narrow slotted area of a spar track, and thus, are retained within a larger internal portion thereof. Lowering or raising a sail requires the slides and boltrope to slide within the spar track usually under heavy loadings of the sail. As alluded to previously, maintaining the spar tracks for the free running of the slides and boltropes are of prime importance for sail, track and slide preservation, as well as sailboat safety and enjoyment. Impediments to the lowering and raising of sails through the binding, jamming, buckling or breaking of slides and boltropes can be disastrous. This is particularly true on choppy or rough water and windy during conditions.

Friction caused by the effects of weathering and corrosion are the main villains to prevent the free and sure running of boltropes and slides within the spar tracks. A build-up of grime, and when in seawater, salt, is an ongoing problem with tracks and slides fabricated from plastic. Dampness, salt spray and high humidity exposes all metal tracks and metal slides to a constant threat of corrosion and oxidation. Even stainless steel and aluminum fittings will corrode or oxidize under certain circumstances, depending on the alloy used in their manufacture, and the amount of exposure the stainless steel and aluminum receive.

Metal tracks and slides, like all metals used for marine applications, are normally subjected to three types of corrosion, which contributes to causing undesirable friction and related difficulties in sail handling. The three types are galvanic corrosion, electrolyte corrosion and atmospheric corrosion.

Generally, galvanic corrosion occurs when two dissimilar metals, wherein one acts as an anode and the other acts as a cathode, are coated with an electrolyte. An electrolyte can simply be described as a liquid that produces an electric current. The current flows from the anode to the cathode which causes corrosion through deterioration of the anode. Large bodies of freshwater usually carry impurities that can harmfully serve as an electrolytic. Saltwater, however, is a much better conductor than freshwater, and thus, poses a more serious problem to metal spar tracks and slides.

Electrolytic corrosion normally results from an electric current coming from an outside source, such as a leakage due to an improper grounding systems, and is not self-generating. An electrolytic must still be present to carry the current from the anode to the cathode, but the metals do not have to be dissimilar.

Lastly, atmospheric corrosion usually occurs through a presence of corrosive elements such as oxygen, carbon dioxide, sulfur and chlorine with water or dampness. Atmospheric corrosion typically results in etching, pitting and rusting in iron, steel and other ferrous metals. Also, atmospheric corrosion forms greenish or brown oxide films on bronze and brass, as well as causing brittleness in brass. Similarly, it results in pitting and the forming of cloudy or dull oxide streaks or films on aluminum spars with extruded tracks.

As mentioned previously, the results of corrosion-induced pitting, rusting and the forming of oxide films and streaks at the metal tracks and slides, as well as the build-up of salt or grime thereon increases the unwanted friction between surfaces of the tracks and slides. This friction resists the movement of the slides and boltropes and effectively acts to break their movement during sail hoisting or lowering.

In some instances, slides bent or buckled through jamming cause an additional stress to adjoining sail cloth resulting in premature wear, fatigue and subsequent breakdown or failure. Additionally, the build-up of salt or grime or the fouling effects of corrosion within the spar tracks often acts as an abrasive. The abrasive track surface frequently results in harmful chafing and abrasion of the boltrope as it runs through the track, especially when the boltrope is under tension, and there is a likelihood of movement. Unfortunately, boltrope tension and movement are conditions that are almost always present when a sailboat is on the water. Further, metal tracks which discolor through oxidization, in turn, often undesirably discolor or stain the sail cloths. Discolored and stained sailcloth enhances the sail's ability to pick up abrasive dirt and grime and increases its ability to and associated premature failure.

Various approaches to the needs and problems associated with eliminating friction caused by corrosion and weathering at the surfaces of spar tracks and mating slides and boltropes include, for example, the following. Bare metal spars and their tracks are usually washed and treated with a mild abrasive or a sandpaper to remove corrosion, and thereafter, are waxed to reduce friction. However, this surface treatment is extremely difficult to perform once the spar has been stepped or mounted to the sailboat keel or the deck. The upper, narrow, slot-like opening in the spar track makes reaching, cleaning and coating the wider, lower portion of the internal track surface particularly difficult even when the spar is not standing.

Once the spar is stepped, the internal track surface, especially the portion of the track adjacent the mast head, is virtually inaccessible without going aloft in a bosun's chair, climbing steps, or hauling oneself aloft on a halyard. Notably, a bosun chair is typically needed to free both hands to effectively perform the cleaning and maintenance tasks. Trying to enter the bosun's chair from climbing steps at the sparhead while the boat is even gently rocking can result in being pitched over, and thus, can be very risky. Additionally, building or purchasing climbing steps, which are normally welded or riveted to aluminum spars and bolted to wooden spars, are usually a costly option.

Bare metal spar tracks are also painted to form an impervious layer thereon. This layer denies access to the metal by an electrolyte and oxygen and prevents current flow and oxidation. The main shortcomings of paints, resins, lacquers and similar coatings and films is that the coating must be applied to the entire internal surface, that is, every corner, crevice and curve. As previously mentioned, it is extremely troublesome to generally access and coat the internal track surface of a standing spar without going aloft. To coat the entire internal track surface even with the help of a spraying device is difficult whether the spar is standing, or is laying down in a cradle. This shortcoming is greatly intensified when it is realized that preventing microscopic holes supplied by time and abrasion within the protective coatings that allow corrosion to begin is especially tough.

Bare metal tracks, other than stainless steel, are frequently anodized to coat the metal with a corrosive-resistant material. Chrome and gold are sometimes used for this purpose. Unfortunately, scratches or damages of any kind to the anodized surface exposes the metal and initiates corrosion. Also, corrosive-resistent anodic coatings frequently do not protect against direct spray that detrimentally pits the anodized surface with deposits.

To protect anodized surfaces from pitting, they are often initially treated with a clear plastic lacquer or an epoxy paint and then waxed. However, as previously mentioned, the application of paints and other coatings to provide a protective film over the entire internal spar track surface is an arduous task after the spar has been stepped.

Some metals other than the popular aluminum have been selected to fabricate tracks because of their extremely corrosive-resistant characteristics and their excellent strength, such as, monel and titanium. However, these metals are comparatively expensive with respect to aluminum. Other metals are often too heavy for track applications.

Some metal tracks are provided with slides having metal or plastic ball or roller bearings and are mechanically designed to be adjustable under sail loads. However, these slides are typically comparatively complex in construction, are mostly used on large boats from about 35 feet and longer, and are comparatively costly with respect to other slides.

Some spar tracks use plastic and nylon slides. The disadvantage of plastic and nylon slides in seawater is that even a slight coating of salt on them will often stop the movement of the plastic and nylon slides.

To cope with these problems, prior art cleaning, lubricating and waxing devices usually comprised rags and sponges, which are coated with an anti-corrosive material and caused to run inside a spar tracks by tieing the rag or sponge between a downhaul line and a hoisting line. A major disadvantage of such devices, however, is that the rags and sponges do not satisfactorily reach and contact the entire internal surface of the spar tracks.

U.S. Pat. No. 4,278,472 describes an implement for cleaning bolt line tracks in sailboats, which includes a pair of stiff, transversely spaced, insertion cores that are enclosed in a bonded nappy fabric to make a stiff, non-buckling assembly. The implement is connected between a halyard line and a trailing line, and the first core is inserted into the bolt line track. The two lines are worked reciprocally to move the implement along the bolt line track to dislodge material. However, this stiff, non-folding, non-buckling design may not allow substantial conformance to and contact with the entire internal bolt line track surface; may not be adjusted to substantially conform to and engage the entire internal surface after insertion within the track when it initially does not conform to nor engage the track surface; and may not allow the second core to assist the inserted first core in cleaning the upper slot-like area of the bolt line track.

OBJECTS OF THE INVENTION

It is therefore a general object of the present invention to provide a low-cost, easy-to use, device and process to simplify the cleaning and maintenance of spar tracks.

It is another general object to provide a device and process to facilitate and simply the lubricating and waxing of spar tracks.

It is still a general object to provide a device and process to inhibit corrosion of the internal surface of spar tracks.

It is a specific object to provide a low-cost, simply constructed device and simplified process to maintain a spar track to allow the free-running of slides and boltropes under vertical or horizontal sail loadings.

It is another specific object to provide a device and process to clean and maintain of a spar track after the spar is stepped without the need of a bosun's chair, climbing steps, or a need to hoist oneself aloft on a halyard.

It is still a specific object to provide a cleaning and maintenance device for spar tracks that adjustably allows said device to compress and snugly conform to an internal shape of a spar track while maintaining slidable contact therewith.

Additional objects, advantages and novel features of the present invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purpose of the invention as embodied and broadly described herein a spar track cleaning and maintenance device comprises: a compressible, working surface for cleaning, lubricating and maintenance of a longitudinally extending, irregularly-shaped, spherical opening defined by the spar track; at least one first compressible, resiliently flexible, cordage member for inserting into the spar track opening and for slidably engaging an internal surface of the track opening; and a control means for adjustably shaping the working surface and the first cordage member upon being inserted within the spar track opening. The control means adjustably shapes the working surface and the first cordage member, which is integrally formed with the working surface, to allow the working surface and the first cordage member to compress and substantially conform to the shape of the internal track surface and to be in slidable engagement therewith. The compressed working surface and the first cordage member upon being slidably moved within the track opening reduce friction at the internal track surface and enhance the sliding of track slides and boltropes when under loadings from the sail.

BRIEF DESCRIPTION OF THE INVENTION

The accompanying drawings, which are incorporated in and from a part of the specification, illustrate the preferred embodiments of the invention and together with the description, serve to explain the principals of the invention. In the drawings.

DETAILED DESCRIPTION OF THE INVENTION

Figure 1:
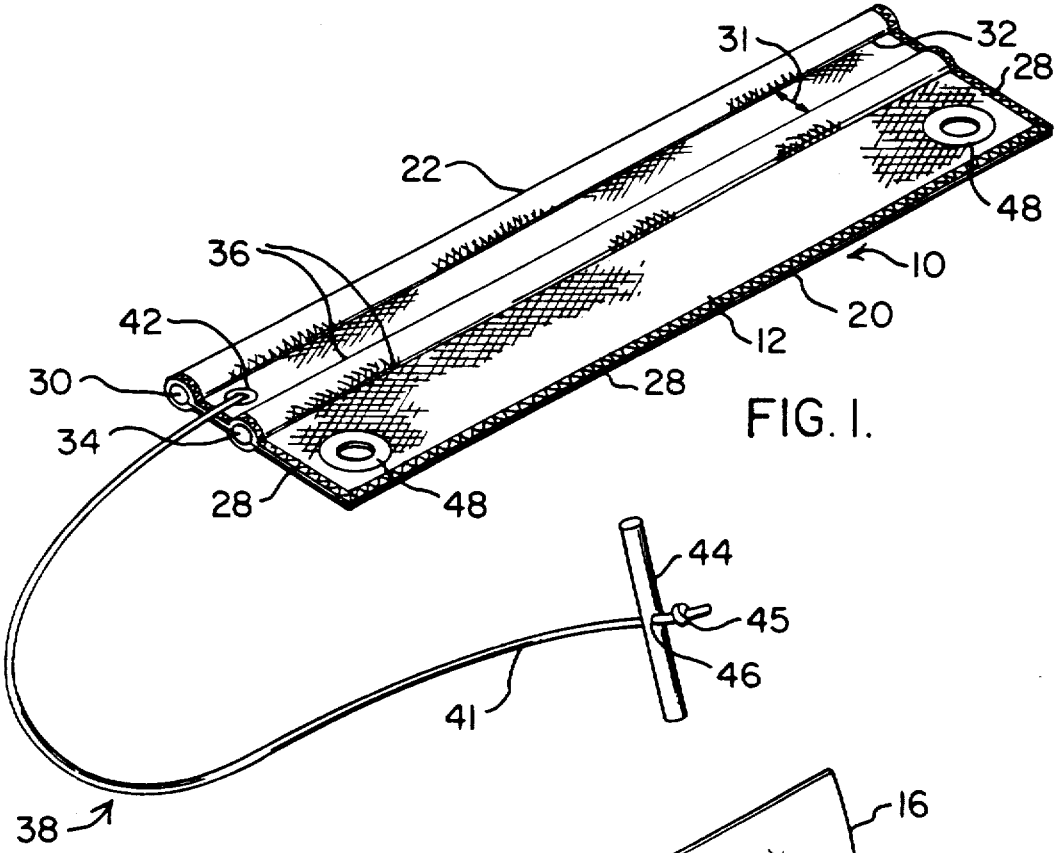
FIG. 1 is a perspective view of the spar track cleaning and maintenance device constructed in accordance with the invention.
Figure 2:
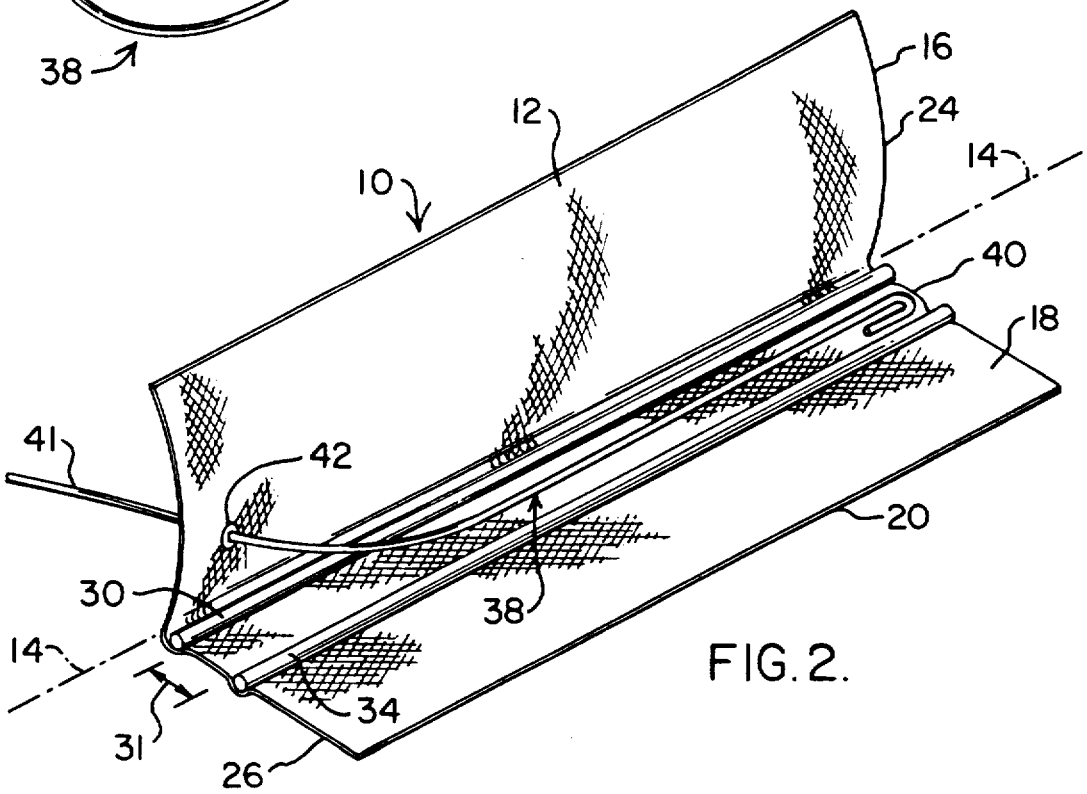
FIG. 2 is a perspective view of the spar track cleaning and maintenance device of FIG. 1 with sides thereof separated illustrating a control means connected thereto in accordance with the invention.

Referring now to the drawings, and more particularly to FIGS. 1 and 2, the present invention relates generally to a spar track cleaning and maintenance device 10. Device 10 comprises a compressible or contractible, resiliently flexible, fabric member 12 having suitable characteristics to resist abrasion and chemical attack by cleaning and maintenance materials. Fabric member 12 defines a working surface or bearing surface that is capable of receiving or being impregnated with a friction-reducing material.

As is contemplated and defined herein, a friction-reducing material includes any number of well-known coatings used to protect spar tracks and spar grooves from the harmful effects of weathering and corrosion. The friction-reducing material also includes several well-known materials used to reduce friction between boltropes, slides, spar tracks, and grooves at their surfaces of contact. Such friction-reducing materials include, for example, but are not limited to paints, lubricants, waxes, oils, lacquers, abrasives, resins, gels, soaps and cleaning solvents. Incidently, it will be noted that spar tracks are substantially equivalent to spar grooves, that spar tracks are used interchangeably for spar grooves in the marine art, and therefore, are used herein to define spar grooves.

Fabric member 12 may be manufactured from numerous well-known natural materials such as cotton cloths and woolen cloths, as well as synthetic materials such as nylon, polyester and teflon cloths. Fabric member 12 is preferably manufactured from cotton. However, it will be understood that other suitable materials having adequate compression and tensile characteristics, as well as adequate weave, finish, porosity and abrasiveness, and other characteristics for bearing friction-reducing materials thereon may be used to manufacture fabric member 12, as will occur to those skilled in the art.

Fabric member 12 comprises a rectangular shape and is folded along a longitudinally extending, imaginary centerline 14 to form a sleeve having two sides 16 and 18. The folded fabric member 12 defines two opposed, transversely spaced, longitudinally extending first and second peripheral edges 20 and 22, and two opposed, transversely extending, peripheral edges 24 and 26.

Longitudinal edge 20 and transverse edges 24, 26 for each of the two sides 16 and 18 are preferably permanently attached to one another through serge stitching 28. It will be apparent that longitudinal edge 20 and transverse edges 24, 26 are not limited to being attached with serge stitching. Alternatively, longitudinal edge 20 and transverse edges 24, 26 may be attached through other well known stitches, such as zig-zag stitching or straight stitching.

Moreover, longitudinal edge 20 and transverse edges 24, 26 may also be attached through any number of well-known adhesives or fasteners. Such adhesives and fasteners should be suitable for enabling the attached longitudinal edge 20 and transverse edges 24, 26 to provide little resistance to crushing and distortion. The adhesives and fasteners should also be suitable for receiving tensile and compression forces during cleaning and maintenance applications, while simultaneously inhibiting failure or separation of the longitudinal edge 20 and transverse edges 24 and 26, as will become more apparent hereinafter.

Enclosed within the folded fabric member 12 is a first compressible or contractible, resiliently flexible, elongated, cordage member 30. Cordage member 30 may be fabricated from many well-known natural materials and synthetic materials having the aforesaid suitable flexibility and compression characteristics required for cleaning and maintenance applications. Suitable tensile and strength characteristics, as well as wear-resistent and chemical-resistent characteristics are also desirable. Examples of such materials are nylon, polyester, manilla, sisal, hemp, coir, metal and etc. A preferred cordage material comprises nylon having a double-braid-type weave.

Figure 5:
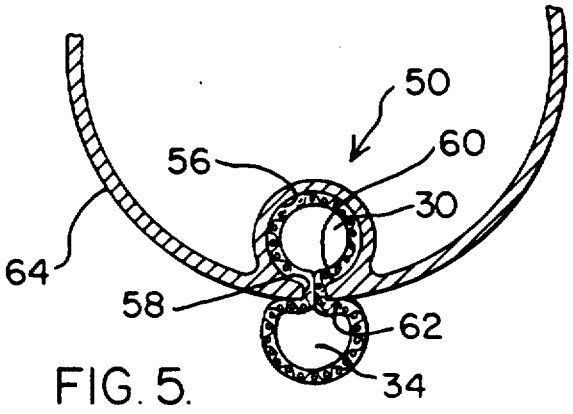
FIG. 5 is a cross-sectional, top view of the spar track cleaning and maintenance device of FIG. 1 illustrating a working surface and united first and second cordage members disposed within a spherical-shaped internal, spar track surface.

As is best illustrated in FIG. 5, cordage member 30 preferably comprises an external shape that corresponds to the internal shape of the spar track surface. This is accomplished by providing cordage member 30 with a spherical shape for use with spherically shaped tracks, as is depicted in FIG. 5.

Cordage member 30 is disposed within the folded fabric member 12 so as to extend longitudinally in parallel relationship to adjacent edge 22. Additionally, cordage member 30 is preferably attached through stitching to fabric means 12 along a longitudinally extending edge 32 thereof, which edge 32 is transversely spaced from edge 22.

A second compressible or contractible, resiliently flexible, elongated cordage member 34 is disposed within the folded fabric member 12 so as to longitudinally extend in parallel relationship to first cordage member 30. Cordage member 34 is constructed of the same material as cordage member 30, and is preferably attached through stitching to folded fabric means 12 along longitudinally extending opposed edges 36 thereof. Upon inspection of FIGS. 1 and 2, a distance 31 between the two cordage members 30, 34 is sufficiently narrow to allow cordage member 34, when subjected to compression, to substantially slidably contact the slotted portion of the spar track, as will be more fully explained hereinafter.

Referring again to FIGS. 1 and 2, in accordance with the invention, fabric member 12 includes a control or regulator means 38 for adjustably shaping the working surface of fabric member 12. Control means 38 comprise a high-strength, flexible member and notably is preferably fabricated from the same materials used to fabricate the two cordage members 30, 34. Additionally, control means 38 is preferably in the form of a drawline as will be more fully explained hereinafter.

Control means 38 is longitudinally disposed within folded fabric member 12 between the two cordage members 30, 34 so as to extend in parallel relationship therewith. As is best illustrated in FIG. 2, control member 38 also defines a first peripheral end 40 thereof, which is attached to fabric member 12 through stitching adjacent transverse edges 24. A second peripheral end 41 of control means 38 projects from fabric member 12 by means of a cringle or a grommet 42 disposed at side 16 adjacent transverse end 26.

Grommet 42 distributes stress and prevents tearing and is attached to fabric member 12 with well-known fastening techniques. Grommet 42 may be fabricated from any number of well-known corrosive-resistant materials normally used in marine applications. Marine metals having anodic corrosive-resistent, protective coatings; metal alloys designed to resist corrosion; and plastics are suitable materials for manufacturing grommet 42. Grommet 42 is preferably manufactured from brass.

As is best illustrated in FIG. 1, peripheral end 41 of control member 38 is connected to a locking or fastening member 44 through a rope knot 45. Locking member 44 comprises a cylindrical-shaped grip or peg member having an aperture 46 centered between opposed ends thereof. Locking member 44 is received by aperture 46 such that locking member 44 is slidably moveable, back and forth, in a first direction towards grommet 42 and in an opposite direction towards rope knot 45.

While the locking member 44 has been described in connection with a cylindrical-shaped grip fastened to peripheral end 41 of a drawline with a rope knot, one skilled in the art will appreciate that the adjustable, locking arrangement is not necessarily so limited, and that the arrangement may comprise any number of well-known grips suitably for cinching and releasably maintaining fabric member 12 in a compressed condition, as will be more fully explained hereinafter.

Fabric member 12 further defines two longitudinally spaced grommets 48 disposed in a planar portion of fabric member 12, which planar portion extends from cordage member 34 to longitudinal edge 20. Each one of the two grommets 48 is disposed adjacent to a different one of the two transverse edges 24 and 26. Moreover, the two grommets 48 are preferably fabricated from the identical material used to fabricate grommet 42 and are attached to fabric member 12 in the same manner used to attach grommet 42 thereto.

It will now be appreciated that the size of device 10 depends on the specific cleaning and maintenance application being performed, as well as the type and size of the spar track being treated. In the present embodiment, device 10 will be from around about 152 mm (6 in) long to around about 610 mm (24 in) long, and from around about 76 mm (3 in) wide to around about 152.4 mm (6 in) wide.

It will further be appreciated that device 10 is not limited to a folded-sleeve construction. Specifically, device 10 may be fabricated with two completely separated sides 16, 18 with longitudinal edge 22 being attached in any well-known manner suitable for allowing device 10 to satisfactory conform to the internal shape of spar track surface, as will occur to those skilled in the art. In this construction, the remaining edges 16, 18 and 20 would be attached, as previously described.

Moreover, it will be appreciated that device 10 is not limited to always having a second cordage number 34. That is, device 10 may comprise solely the first cordage number 30 in conjunction with the control means 38 to perform cleaning and maintenance, as will become more apparent hereinafter.

Figure 3:
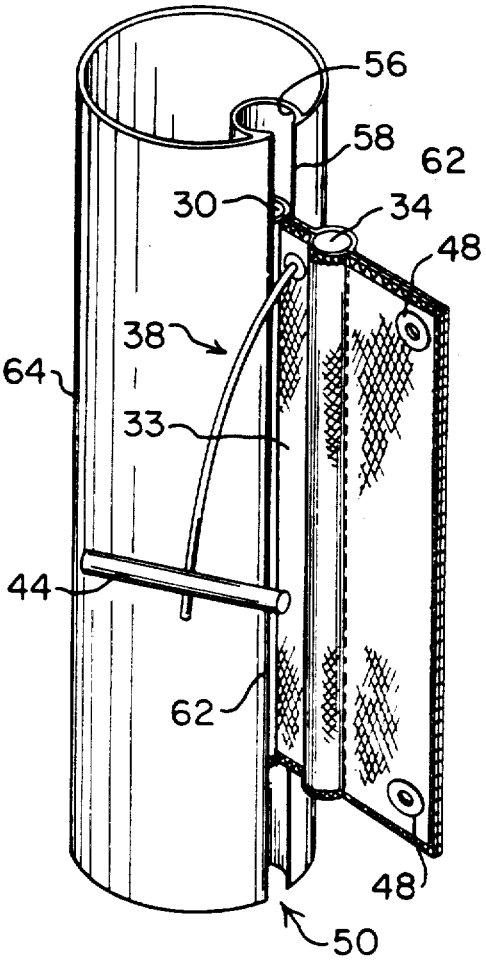
FIG. 3 is a perspective view of the spar track cleaning and maintenance device of FIG. 1 inserted within an extruded track of a hollow aluminum spar before being adjustably compressed to effect cleaning and maintenance in accordance with the invention.
Figure 4:
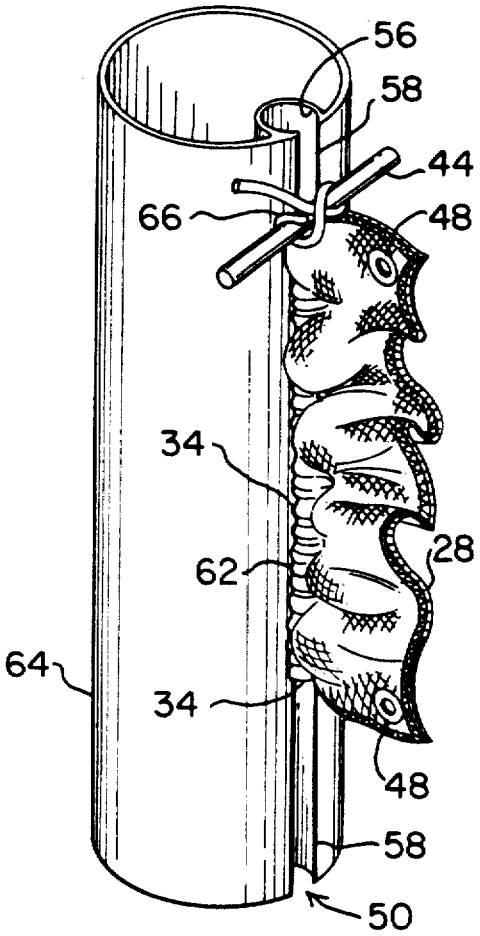
FIG. 4 is a perspective view of the spar track cleaning and maintenance device of FIG. 1 inserted within an extruded track of a hollow aluminum spar upon being adjustably compressed to slidably engage the track opening in accordance with the invention.

The process of using device 10 for cleaning and maintenance of spar tracks may be best understood upon reference to FIGS. 3 through 5. To clean and provide preventive maintenance at an internal and external working surface of a spar track 50, device 10 is initially inserted or bent on to spar track 50 through an opening therein. It will be noted that the specific details of the opening which receives device 10 forms no part of the present invention and has been omitted from the drawing for the sake of clarity and brevity, since such openings are well known in the marine art. It will be further noted that to optimally clean and provide maintenance to a spherically-shaped, internal, spar track surface 56, as depicted in FIG. 5, spherical-shaped cordage members 30, 34 are used.

Upon inserting device 10 within spar track 50, a pulling or a tugging means is attached to each one of the two grommets 48 to enable fabric member 12 to be reversibly moved therein. It is contemplated that one of the pulling means comprises a halyard or similar rope or line normally utilized for hoisting sails, while the remaining pulling means comprises any downhaul line or similar rope normally utilized for lowering sails. Halyards and downhaul lines are well-known in the marine art, and thus, have been omitted from the drawings for the sake of clarity and brevity. The halyard is attached through a rope knot or shackle to one of the two grommets 48, and is pulled to move the fabric member 12 in a first upward direction. Likewise, the downhaul is attached to the remaining grommet 48 through a rope knot or shackle and is pulled to move the fabric member 12 in a second direction opposite to the first direction.

It will now be apparent that sequentially applying pulling forces to the halyard and downhaul lines causes a smooth slipping movement of device 10 within spar track 50 in first and second reversible directions. It will further be apparent that device 10 is not limited to cleaning and maintenance requiring vertical movement, but may be employed to effect horizontal movement as well. For example, the device 10 can be used for cleaning and maintenance applications at a track disposed along a horizontally positioned boom-type spar.

Thereafter, the control means 38 is actuated or operated to adjust or regulate the compression of the external surface of fabric member 12 and cordage member 30 united thereto. A pulling or tugging force is initially applied to the peripheral end of control means 38 through locking member 44. In response to the pulling force, fabric member 12 and cordage member 30 are squeezed within a wide portion 56 of the internal surface of spar track 50 so as to substantially correspond to the shape thereof.

Additionally, cordage member 34 and the associated working surface 33, which transversely extends between cordage members 30, 34 are also squeezed to substantially correspond to the identical shape of the narrow-slot-like portion 58 of the internal track surface. As just mentioned, track surface portion 58 is comparatively smaller or narrower than track surface portion 56, such that, a third portion 60 of the internal track surface, where the two portions 56, 58 merge, is squeezed between the two cordage members 30, 34.

Moreover, transverse surface 33 is caused through the squeezing to be in substantial contact with third internal surface 60. Notably, third portion 60 of the internal spar track surface is defined herein as all bevels or angled or slanted surface areas defined by the merged internal surfaces 56, 58, or other surface portions thereof.

It will now be appreciated that during the operation of control means 38, cordage member 34 shortens and swells so as to form a sinusoidal-like curve or shape, while substantially snugly engaging an external surface 62 of the extruded spar 64 adjacent the slot-like spar track opening 58 therein, as is best illustrated in FIG. 4. Incidently, it will further be appreciated that serge stitching 28 enables the device 10 to be subject to tensile and compression forces, while substantially inhibiting failure or separation of longitudinal edge 20 and transverse edges 24, 26 without a need to use reinforcing material thereabout.

Upon activation of control means 38, the desired level of contraction and snugness is adjustably maintained by slidably moving locking member 44 along peripheral end 41 of control 38, which projects from grommet 42. By this adjustment, locking member 44 is releasably cinched or put in contact with fabric member 12 through a rope knot 66. When in contact with fabric member 12, locking member 44 functions to check tensile forces acting thereon through the compression of fabric member 12, and thereby, prevents the expansion of fabric member 12.

Thereafter, the cleaning and maintenance of spar track is performed by alternately slidably moving the compressed device 10 within spar track 50, back and forth, to and fro, in first and second opposite directions. For this purpose, the movement can be an oscillating, vibratory-type movement, or it can be a sustained slipping-type movement. A sustained movement is performed by initially moving device 10 in a first direction over a substantial longitudinal length of a spar track, and then subsequently reversibly moving the device 10 in an opposite direction.

In accordance with further aspects of operation, fabric member 12 may also be caused to release the friction-reducing material impregnated therein so as to feed onto internal spar track surfaces 56, 58, and 60, as well as external surface 62 after being hoisted aloft. For example, fabric member 12, while impregnated with the friction-reducing material, can be inserted within spar track 50 and be advanced in a first upward vertical direction by the halyard line attached thereto. An additional downhaul line connected to locking member 44 can then be throttably pulled to actuate control means 38. Throttling control means 38 compresses device 10 and measurably or variably releases the impregnated friction-reducing material therein. It is obvious that the released material under the pull of gravity will controllably flow onto and down internal track surfaces 56, 58 and 60 and adjacent external spar track surface 62. It will be evident that during the release of the friction-reducing material, tension will be maintained on the hoisting and trailing lines, as well as on the throttlable downhaul line connected to locking member 44.

Having observed the details of construction and operation of the device 10, it will be apparent that the present invention provides several additional advantages as follows. Device 10 is of simple construction and provides a low-cost simple method for substantially improving the ease of hoisting and lowering of sails by reducing friction between the external sliding surfaces of tracks and slides and boltropes and the sliding surfaces of the spar track so as to prevent jamming, binding and buckling. Device 10 allows cleaning and maintenance of a spar track to reduce friction therein after the spar has been stepped without a need for a bosun's chair, climbing steps, or a need to hoist oneself aloft on a halyard. Device 10 improves an ability to reach and to fully coat the entire internal surfaces of a spar track including all crevices, curvatures, microscopic holes, abrasion and scratches with a friction-reducing material.

Other advantages can also be described. For instance, device 10 improves an ability to inhibit the forming of oxides and associated discoloration of anodized metals, particularly aluminum, which, in turn, improves an ability to minimize an associated discoloration and sailing of sail cloths. Device 10 increases sailing safety by enabling sails to be easily lowered and hoisted. Device 10 simplifies maintenance and cleaning procedures. Device 10 minimizes harmful chafing and abrasion of boltropes at the spar tracks, which, in turn, inhibits premature failure of the sailcloth. Finally, the ability to adjust the compression of device 10 within a spar track allows one device size to be used with spar tracks that initially provide a loose fit with device 10 upon insertion into the spar track without a need to change to a second device having a larger surface area.

The foregoing description of the preferred embodiment of the present invention has been presented for purposes of illustration and description. It is not intended to be exhaustive or to limit the invention to the precise form disclosed; obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. A device for maintaining a spar track for a free running of mating slides and boltropes under loadings of a sail through cleaning and maintenance, said device comprising:

a. a compressible working surface for cleaning, lubricating, and maintenance of a longitudinally extending, irregularly-shaped, spherical opening defined by said track, said working surface being adjustable for substantially conforming to the curvature of an internal surface of said track opening;

b. at least one first compressible, resiliently flexible, cordage member for inserting into said track opening and for slidably engaging the internal surface of said track opening, said first cordage member being integrally formed with said working surface; and c. a control means for adjustably shaping said working surface and said first cordage member upon being inserted within said track opening, said control means adjustably shaping said working surface and said first cordage member to compress and substantially conform to said irregular spherical shape of said internal surface of said track opening, said working surface and first cordage member being in slidable engagement with said internal surface when subjected to compression through said control means, said compressed working surface and said first cordage member, upon being slidably moved within said track opening, functioning to reduce the effects of corrosion and thereby enhance the running of said slides and boltropes under said sail loadings, and wherein said device comprises a locking member for holding fast a desired amount of compression of said working surface and first cordage member obtained through an adjustment of said control means.

2. The device of claim 1, wherein said working surface comprises a pair of spaced fasteners for allowing said slidable movement within said track opening when said fasteners are subjected to a pulling force.

3. The device of claim 2, wherein said control means comprises a draw line.

4. The device of claim 2, wherein, said working surface and said first cordage member is enabled by said control means to said compress and substantially correspondingly fit said irregular shape of said internal surface when said device is initially inserted within said track opening without a need to use a different second device comprising a comparatively larger surface for engaging and fitting snugly within said internal surface of said track opening.

5. The device of claim 2, wherein said working surface comprises a natural cloth.

6. The device of claim 2, wherein said working surface comprises a synthetic cloth.

7. The device of claim 2, further comprising a second, compressible, resiliently flexible, cordage member; said second cordage member being adjustable by said control means for assisting said working surface and said first cordage member in engaging said internal surface of said track opening; said second cordage member being integrally formed with said working surface.

8. The device of claim 7, wherein said first and second cordage members comprise a rope.

9. The device of claim 7, wherein said first cordage member slidably engages a first portion of said internal surface of said track opening; said second cordage member slidably engages second portion of said internal surface of said track opening; said first internal surface portion being comparatively wider than said second internal surface portion, such that, a longitudinally extending neck-shaped portion of said track opening, defined by said first and second internal surface portion, is in between said first and second cordage members and is in substantial slidable contact therewith, when said working surface and said first and second cordage members are compressed within said track opening.

10. The device of claim 9, wherein said working surface comprises a flat, rectangularly-shaped cloth capable of receiving a friction reducing material and a cleaning material thereon; said cloth being folded along a longitudinally extending imaginary centerline of said cloth so as to form a sleeve having two sides, said folded cloth defining opposed transversely spaced, longitudinally extended, first and second peripheral edges for each side of said two sides, said folded cloth defining opposed transversely extending first and second peripheral edges for each side of said two sides, said transversely extending first and second peripheral edges extending in a direction substantially perpendicular to said longitudinally extending first and second peripheral edges; a first longitudinally extending peripheral edge of said two longitudinally extending peripheral edges being defined by said fold along said imaginary centerline; a remaining second longitudinally extending peripheral edge being sewn with serge stitching; and said first and second transversely extending peripheral edges for each of said two sides being sewn with serge stitching.

11. The device of claim 10, wherein said first cordage member is disposed within said folded cloth so as to longitudinally extend adjacent said fold at said first longitudinal peripheral edge; said second cordage member being enfolded within said cloth so as to longitudinally extend in parallel relationship to said first cordage member; said first cordage member defining a longitudinally extending edge, said first cordage member being longitudinally attached to and within said folded cloth member at the longitudinally extending edge thereof, said longitudinally extending edge of said first cordage member being transversely spaced from said first longitudinally extending peripheral edge defined by said fold, said second cordage member defining longitudinally extending opposed edges, said longitudinally opposed edges of said second cordage member being attached to and within said folded cloth along the longitudinally extending opposed edges thereof; said first and second cordage member being attached through stitching.

12. The device of claim 11, further comprising a second control means, said second control means comprises a third cordage member, said third cordage member being longitudinally disposed between said first cordage member and said second cordage member so as to extend in parallel relationship therewith; said third cordage member defining a first peripheral end, said first end of said third cordage member being attached adjacent one sewn edge of said first and second transversely extending sewn edges, a second peripheral end defined by said third cordage member projecting from said folded cloth adjacent a remaining sewn edge of said first and second transversely extending sewn edges; said projecting portion of said third cordage member forming a means for receiving a pulling force; said means for receiving a pulling force enabling said working surface and said first and said second cordage members to adjustably conform to and slidably engage said curvature of said internal surface of said track opening, when subjected to said pulling force.

13. The device of claim 12, wherein said locking member receives said pulling force and comprises a grip member; said grip member being a releasibly attached to said projecting portion of said third cordage means; said grip member, when subjected to said pulling force allowing said third cordage member to cause a desired amount of compression of said working surface and said first and second cordage members, and said grip member allowing said desired amount of compression to be adjustably maintained upon said first and second cordage members and said working surface being inserted in said track opening.

14. The device of claim 13, wherein said folded cloth defines a comparatively planar portion transversely extending from said second cordage member to said second longitudinally extending peripheral edges; said planar cloth portion including two longitudinally spaced grommets disposed therein; one grommet being disposed adjacent each one of said first and second transversely extended peripheral edges said two grommets allowing said folded cloth to be slidably moved longitudinally, back and forth, within said track opening, when said device is inserted within said track opening; and when each one of said two grommets is being sequentially subjected to a pulling force.

15. The device of claim 14, wherein a first one of said two grommets is releasably attachable to a hoisting line for transmitting thereto a pulling force, and the remaining second grommet is releasably attached to a downhaul line for transmitting thereto said pulling force.

16. The device of claim 15, wherein said serge stitching enables said device to be alternatively subjected to tensile and compression forces during use of said device for cleaning and maintenance, while substantially inhibiting failure of said serge stitching along said longitudinally and transversely extending peripheral edges without a need for using reinforcing material at said edges to prevent failure of said stitching or separation of said transverse and longitudinal peripheral edges.

17. The device of claim 16, wherein at least one of said cordage members comprises a wire.

18. The device of claim 16, wherein at least one of said cordage members comprises natural fibers.

19. The device of claim 18, wherein at least one of said cordage members comprises strands of synthetic fibers.

20. The device of claim 16, wherein said projecting portion of said third cordage member for receiving a pulling force extends from a third grommet.

21. The device of claim 20, wherein said two grommets attached to said planar portion of said folded cloth and said third grommet comprise a material substantially resistent to corrosion.

22. The device of claim 21, wherein said grommets are metal.

23. The device of claim 21, wherein said grommets are plastic.

24. The device of claim 7, wherein said working surface is flexible, resilient and capable of receiving and maintaining thereon a friction-reducing material and a cleaning material for enhancing an ability of said device to reduce a resistance of said internal track surface to the sliding motion of said slides and boltropes within said track opening while being subject to loadings from a sail, subsequent to said device being used for maintenance of said track opening.

25. The device of claim 24, wherein said friction-reducing material comprises an abrasive cloth for enhancing a cleaning, polishing and buffing of said internal track surface.

26. The device of claim 24, wherein said friction reducing material comprises a material for lubricating said internal surface of said track opening to reduce friction.

27. The device of claim 24, wherein said cleaning material comprises soap.

28. The device of claim 24, wherein said friction reducing material comprises a wax material to reduce friction at said surface of said track opening.

* * * * *